US005346796A

United States Patent [19]

Almog

[11] Patent Number: 5,346,796

[45] Date of Patent: Sep. 13, 1994

[54] ELECTRICALLY STABILIZED LIQUID TONERS

[75] Inventor: Yaacov Almog, Rehovot, Israel

[73] Assignee: Spectrum Sciences B.V., Wassenaar, Netherlands

[21] Appl. No.: 915,291

[22] Filed: Jul. 20, 1992

[51] Int. Cl.[5] ..... G03G 9/12; G03G 9/135

[52] U.S. Cl. ..... 430/115; 430/114; 430/904; 524/901

[58] Field of Search ..... 430/114, 115, 904, 110; 524/901

[56] References Cited

U.S. PATENT DOCUMENTS

| | | | |
|---|---|---|---|
| 3,753,760 | 8/1973 | Kosel | 430/119 |
| 3,844,966 | 10/1974 | Nelson | 430/115 |
| 3,991,226 | 11/1976 | Kosel | 430/119 |
| 4,059,444 | 11/1977 | Lu et al. | 430/119 |
| 4,772,528 | 9/1988 | Larson et al. | 430/115 |
| 4,783,388 | 11/1988 | El-Sayed et al. | 430/115 |
| 4,897,332 | 1/1990 | Gibson et al. | 430/115 |
| 4,924,766 | 5/1990 | Hitch | 99/421 |
| 4,935,328 | 6/1990 | El-Sayed et al. | 430/115 |
| 4,977,056 | 12/1990 | El-Sayed | 430/115 |
| 5,200,289 | 4/1993 | Harrington et al. | 430/115 |

FOREIGN PATENT DOCUMENTS

| | | |
|---|---|---|
| 0295624 | 12/1988 | European Pat. Off. . |
| 0336386 | 10/1989 | European Pat. Off. . |
| 0456178 | 11/1991 | European Pat. Off. . |

OTHER PUBLICATIONS

Research Disclosure, Sep. 1979, No. 185,pp. 517–518.
International Search Report and Annex.

*Primary Examiner*—John Kight, III
*Assistant Examiner*—Shelley A. Dodson
*Attorney, Agent, or Firm*—Sandler, Greenblum & Bernstein

[57] ABSTRACT

A homogeneous liquid composition, for use in the preparation of liquid toners containing at least one charge director and in which the electrical properties of the charge director(s) is/are stabilized, comprises: (1) insulating non-polar carrier liquid compatible with liquid toners for electrostatic imaging; (2) at least one charge director other than an amine salt; and (3) at least one stabilizing component in an amount effective to stabilize the electrical properties of said at least one charge director, said component being selected from non-quaternary amine salts and being soluble in the carrier, e.g. diethylammonium chloride and isopropylamine dodecylbenzenesulfonate. The invention further relates to liquid toners for electrostatic imaging comprise thermoplastic resin particles dispersed in an insulating non polar carrier liquid, preferably a hydrocarbon having a volume resistivity above $10^9$ ohm-cm and a dielectric constant below 3.0, colorant particles micro-dispersed in said carrier liquid, at least one charge director, and at least one stabilizing component (3), as defined above; a method for producing the liquid toners; and an electrostatic imaging process utilizing the liquid toners.

20 Claims, 5 Drawing Sheets

ELECTRICALLY STABILIZED LIQUID TONERS

FIELD AND BACKGROUND OF THE INVENTION

This invention relates to the field of electrostatic imaging and, more particularly, to the preparation of liquid toners containing components for improving the stabilization of the electrical properties due to the charge directors contained therein.

In the art of electrostatic photocopying or photoprinting, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied or to a computer generated image, thereby forming an electrostatic charge pattern on the photoconductive imaging surface, i.e. a latent electrostatic image having a background portion at one potential and a "print" portion at another potential. The latent electrostatic image can then be developed by applying to it charged pigmented toner particles, which adhere to the "print" portions of the photoconductive surface to form a toner image which is subsequently transferred by various techniques to a copy sheet (e.g. paper).

It will be understood that other methods may be employed to form an electrostatic image, such as, for example, providing a carrier with a dielectric surface and transferring a preformed electrostatic charge to the surface. The charge may be formed from an array of styluses. This invention will be described in respect of office copiers and the like, though it is to be understood that it is applicable to other uses involving electrostatographics including electrostatographic printing.

In liquid-developed electrostatic imaging, the toner particles are generally dispersed in an insulating non-polar liquid carrier, generally an aliphatic hydrocarbon fraction, which generally has a high-volume resistivity above $10^9$ ohm cm, a dielectric constant below 3.0 and a low vapor pressure (less then 10 torr. at 25° C.). The liquid developer system further comprises so-called charge directors, i.e. compounds capable of imparting to the toner particles an electrical charge of the desired polarity and uniform magnitude so that the particles may be electrophoretically deposited on the photoconductive surface to form a toner image.

In the course of the process, liquid developer is applied to the photoconductive imaging surface. Under the influence of the electrical potential present in the latent image and a developing electrode which is usually present, the charged toner particles in the liquid developer film migrate to the "print" portions of the latent electrostatic image, thereby forming the developed toner image.

Charge director molecules play an important role in the above-described developing process in view of their function of controlling the polarity and magnitude of the charge on the toner particles. The choice of a particular charge director for use in a specific liquid developer system, will depend on a comparatively large number of physical characteristics of the charge director compound, inter alia its solubility in the carrier liquid, its chargeability, its high electric field tolerance, its release properties, its time stability, the particle mobility, etc., as well as on characteristics of the developer. All these characteristics are crucial to achieve high quality imaging, particularly when a large number of impressions are to be produced.

A wide range of charge director compounds for use in liquid-developed electrostatic imaging are known from the prior art. Examples of charge director compounds are ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc.

Notwithstanding the undoubted utility of charge directors, however, the charging caused thereby is generally unstable. In particular, lecithin, basic barium petronate (BBP) and calcium petronate (CP), which are used as negative charge directors, are unstable under high voltage conditions. Thus, when a solution of charge director (or a dispersion of toner particles in carrier liquid and containing charge director) is subjected to a high electric field, e.g. during the development process, the charge transport characteristics and conductivity suffer from transient suppression, and it may take several minutes for these characteristics to recover. This leads to unstable printing performance when long print runs are undertaken. Further, such solutions or dispersions containing particularly BBP, CP and to a lesser extent lecithin, tend to lose conductivity in the course of time (after dilution with Isopar or other carrier liquids), so that, e.g., solutions or dispersions containing BBP or CP, when diluted with Isopar, will change their conductivity by about one order of magnitude in a day and a half. In this connection, it may be noted that in U.S. Pat. No. 4,897,332 (Gibson), there is described the use of alkylated polyvinylpyrrolidones in liquid toners, for the purpose of promoting their electrical stability under high voltage conditions.

In an attempt to improve the quality of the image formed, particularly when using liquid toners containing charge directors, it has been suggested to use adjuvants in the toner compositions, such as polyhydroxy compounds, aminoalcohols, polybutylene succinimide, an aromatic hydrocarbon, a metallic soap or a salt of a Group Ia, IIa, or IIIa metal.

U.S. Pat. No. 4,924,766 (Elmasry et al), while mentioning in passing possible use of oligomers containing amine groups as charge directors, is principally concerned with sterically stabilizing the thermoplastic resin in liquid toners; this patent does not address the subject of electrical stabilization.

Two U.S. Patents of Kosel (U.S. Pat. Nos. 3,753,760 and 3,991,226) list many components of liquid toners, including charge directors. The isopropylamine salt of dodecylbenzenesulfonic acid is one of many charge directors disclosed in these two patents. The present inventors have found, however, that this salt is a poor charge director. This finding is not entirely surprising, because the utility of an amine as charge director is believed to depend on its ability to form salts with the polycarboxylic resin particles, from which cations may be split off leaving a charged residue; amine salts could thus not readily perform this function.

Use of an alkylhydroxybenzylpolyamine as an adjuvant in liquid toners, in addition to charge director, is disclosed in U.S. Pat. No. 4,977,056 (El-Sayed), while in U.S. Pat. No. 4,783,388 (El-Sayed et al), there are disclosed liquid toners containing charge directors and an additional component which is a quaternary ammonium hydroxide. There is no suggestion in either patent that the additive stabilizes the electrical stability of the toners.

SUMMARY OF THE INVENTION

It is an object of the present invention to provide a method for producing improved liquid toner compositions containing charge directors and components which stabilize the electrical properties of the charge directors. Other objects of the invention will appear from the description which follows.

The present invention accordingly provides in one aspect, a homogeneous liquid composition, for use in the preparation of liquid toners containing at least one charge director and in which the electrical properties of the charge director(s) is/are stabilized, which composition comprises: (1) insulating non-polar carrier liquid compatible with liquid toners for electrostatic imaging; (2) at least one charge director other than an amine salt; and (3) at least one stabilizing component in an amount effective to stabilize the electrical properties of said at least one charge director, said component being selected from non-quaternary amine salts and being soluble in the carrier.

In another aspect, the invention provides a liquid toner for electrostatic imaging which comprises thermoplastic resin particles dispersed in an insulating non-polar carrier liquid having a volume resistivity above $10^9$ ohm-cm and a dielectric constant below 3.0; colorant particles micro-dispersed in said carrier liquid; at least one charge director other than an amine salt; and at least one stabilizing component (3) as just defined, in an amount effective to stabilize the electrical properties of said at least one charge director.

In yet another aspect, the invention provides a method for producing liquid toner compositions containing charge directors other than amine salts and in which the electrical properties of the charge directors are stabilized, which method comprises the steps of: (A) first making a homogeneous liquid composition comprising components (1), (2) and (3), as defined above, and (B) mixing the with homogeneous liquid composition from step (A) in any order colorant particles, thermoplastic resin particles, and if desired further non-polar carrier liquid, in such manner that the colorant particles and the thermoplastic resin particles are micro-dispersed in the toner composition.

In still another aspect, the present invention provides an electrostatic imaging process which comprises the steps of: forming a charged latent electrostatic image on a photoconductive surface; applying to said surface oppositely charged colorant particles from a liquid toner of the invention as defined herein (or as prepared by the method defined in the preceding paragraph); and transferring the resulting toner image to a substrate.

The carrier liquid, i.e. component (1) as defined above, is preferably an insulating non polar carrier liquid hydrocarbon having a volume resistivity above $10^9$ ohm-cm and a dielectric constant below 3.0.

The amine salts utilized in accordance with the present invention as component (3), as described above, may be for example a salt of an amine with an inorganic acid such as HCl or HBr, or with an organic acid such as a carboxylic acid or a sulfonic acid. Presently preferred organic acids are sulfonic acids, more preferably alkyl-substituted aromatic sulfonic acids and particularly where there is a total within the range of 8–18 carbon atoms in such alkyl substituent(s). The amine component of the amine salt may be for example an aliphatic amine, most preferably a primary, secondary or tertiary aliphatic amine containing from 3 to 8 carbon atoms in the molecule. Non-limiting examples of amine salts which may be utilized in accordance with the present invention are diethylammonium chloride and isopropylamine dodecylbenzenesulfonate.

It has been found that the present toner compositions exhibit excellent time stability of charge and reduction of conductivity loss under high voltage conditions, as well as excellent recovery of charge after subjection to high voltage conditions. Also, use of such toner compositions results in images of very good copy quality and long term stability.

DETAILED DESCRIPTION OF THE INVENTION

Figure 1:
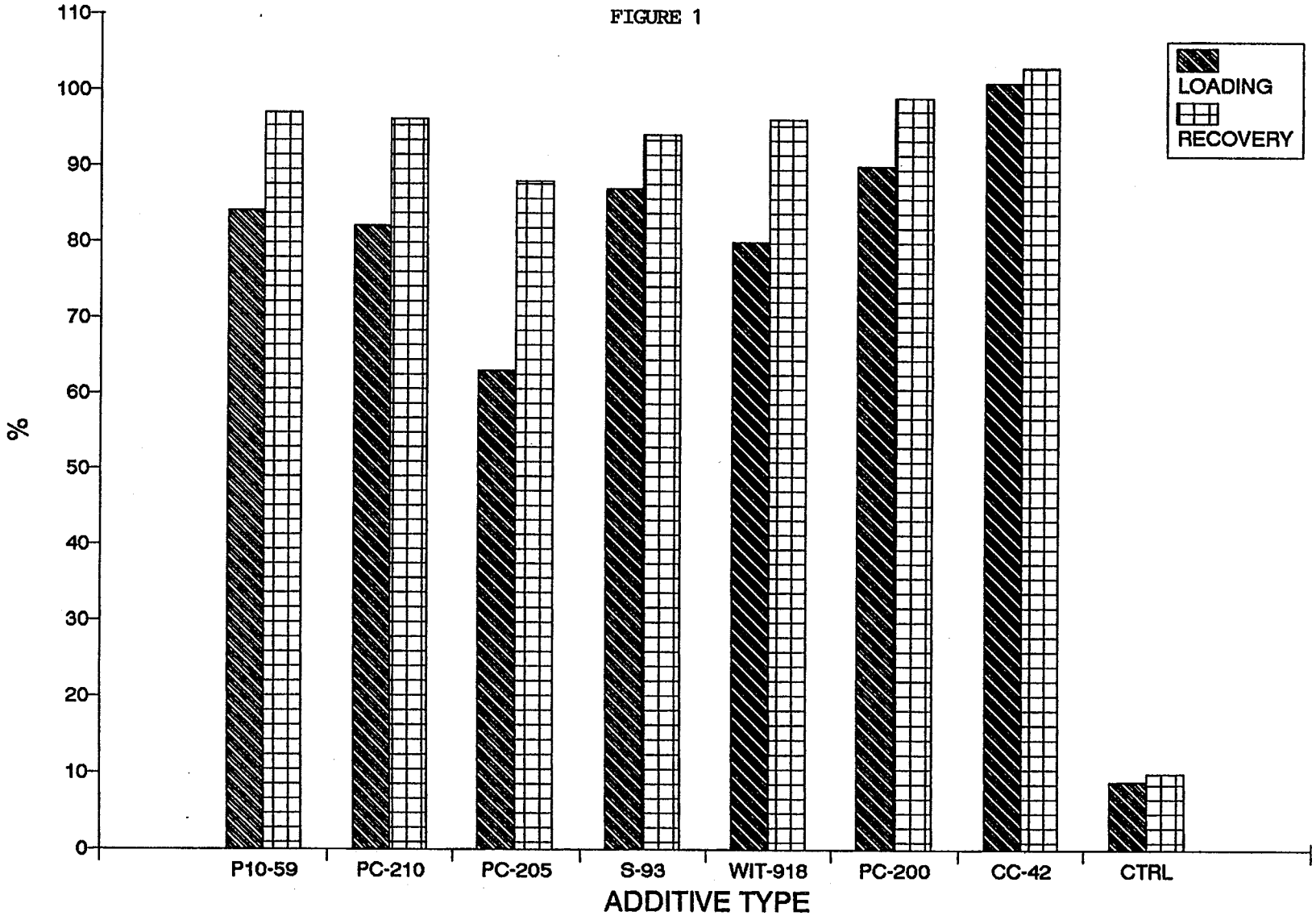
FIGS. 1–4 show the effect of the stabilizing component of the invention on the electrical stability of carrier liquid compositions containing charge directors.

The thermoplastic resins, insulating non-polar carrier liquids, colorant particles and charge directors, which may suitably be used in the toner compositions of the invention are known in the art. Illustratively, the insulating non-polar liquid carrier, which should preferably also serve as the solvent for the charge directors, is most suitably an aliphatic hydrocarbon fraction having suitable electrical and other physical properties. Preferred solvents are the series of branched-chain aliphatic hydrocarbons and mixtures thereof, e.g. the isoparaffinic hydrocarbon fractions having a boiling range above about 155° C., which are commercially available under the name Isopar (a trademark of the Exxon Corporation).

As set forth above, the at least one component for stabilizing the electrical properties of the at least one charge director is selected from carrier soluble non-quaternary amine salts.

The weight ratio of stabilizing component to charge director in the liquid toners preferably falls within the range of 0.001–2.0:1.

The invention will be illustrated by the following non-limiting Example, in which all "parts" are parts by weight.

EXAMPLE (a) Ten parts of Elvax II 5950 (E.I. du Pont) and five parts of Isopar L (Exxon) are mixed at low speed in a jacketed double planetary mixer connected to an oil heating unit set at 130° C. for one hour. Five parts of Isopar L are added to the mix in the double planetary mixer and the whole is mixed for a further hour at high speed. Ten parts of Isopar L, preheated to 110° C. are added, and the mixing is continued without heating until the temperature of the mixture drops to 40° C.

(b) Ninety grams of the product of part (a) is transferred to a Union Process 01 attritor together with 7.5 g of Mogul L carbon black (Cabot) and 120 g Isopar L. The mixture is ground for 24 hours with water cooling (≈20° C.) using 3/16"stainless steel media. The resultant toner particles have an average (weight) diameter of about 2.1 μm.

(c) Three charge directors are used, namely, basic barium petronate (BBP), lecithin, and 50–50 mixtures of lecithin with BBP. 600 g. Isopar L is used to dissolve 60 g. charge director(s) until a homogeneous solution is obtained, to which was added the stabilizing component(s) according to the invention to obtain a homogeneous solution. The amount of stabilizing component(s) may be, e.g., 0.25–10 wt. % of the Isopar solution, but up to 1 wt. % is usually adequate. It is noted that BBP when added to lecithin improves its humidity tolerance (which is poor when used alone); the stabilizing components do not appear to affect the humidity stability of any of the charge directors including the mixtures.

(d) The toner concentrate from part (b) is diluted to a non-volatile solids content of 1.5%, using Isopar L. Charge director solution including stabilizing component, from part (c), is added in an amount of e.g. 5–100 mg. charge director solids per g. of toner solids.

The toners thus produced were tested in a Savin 870 copier and in a high speed electrophotographic printer in which the image is developed on a photoreceptor with a reverse roller developer and then transferred to the final copy sheet via an intermediate transfer member. Print quality was at least equal to that of toner without the stabilizers and was stable under high speed printing conditions, consistent with the following experiments based on the stabilized charge director alone.

Electrical stability under high voltage applications

These measurements are made for solutions containing charge directors alone (as control), or with the addition of stabilizing components, prepared according to part (c) of the Example, above, and diluted with the same carrier liquid. A solution of 0.1 wt. % charge director (and, when present, stabilizing component in the concentrations described below) is placed in an electrical cell having a one mm. separation between plate electrodes. A first pulse of 1500 volts having a duration of 8 seconds is applied to the electrodes and the total charge transported is measured. This charge represents the "basis" value for comparison. After a 1 second delay a second pulse of 1500 volts having a duration of 68 seconds is applied; this pulse is designed to cause depletion of the charge director by high voltage loading. After a further 1 second delay a third pulse of 1500 volts having a duration of 8 seconds is applied and the total charge transported is measured. This charge represents the diminished charge transport capability of the material after being subjected to a high voltage. After a 1 minute wait an additional pulse of 1500 volts having a duration of 8 seconds is applied and the total charge transported is measured; this charge is a measure of the recovery of the charge director after being subjected to high voltage.

The results of this study are shown in FIGS. 1–4, which show clearly that addition of the stabilizing components in accordance with the invention improved both the pulse loading and recovery characteristics of the charge director. In the Figures, the other abbreviations used have the following meanings:

GB=isopropylamine dodecylbenzenesulfonate (ICI G3300B); CC-42=diethylammonium chloride (WITCO-EMCOL PPG-40); P10-59, S-93=amine dodecylbenzenesulfonate (WITCONATE P10-59, S-93); PC-200, PC-205, PC-210=amine alkylarylsulfonates of increasing molecular weights (WITCOR); WIT-918=amine sulfonate (WITFLOW 918).

The charge director compositions in the Figures (concentrations of stabilizing components shown in parentheses) were prepared as follows:

FIG. 1: 0.05 g lecithin (LAN) and 0.05 g BBP, with 0.01 g of the stated stabilizing component according to the invention, were dissolved in Isopar L to make 100 g total solution.

Figure 2:
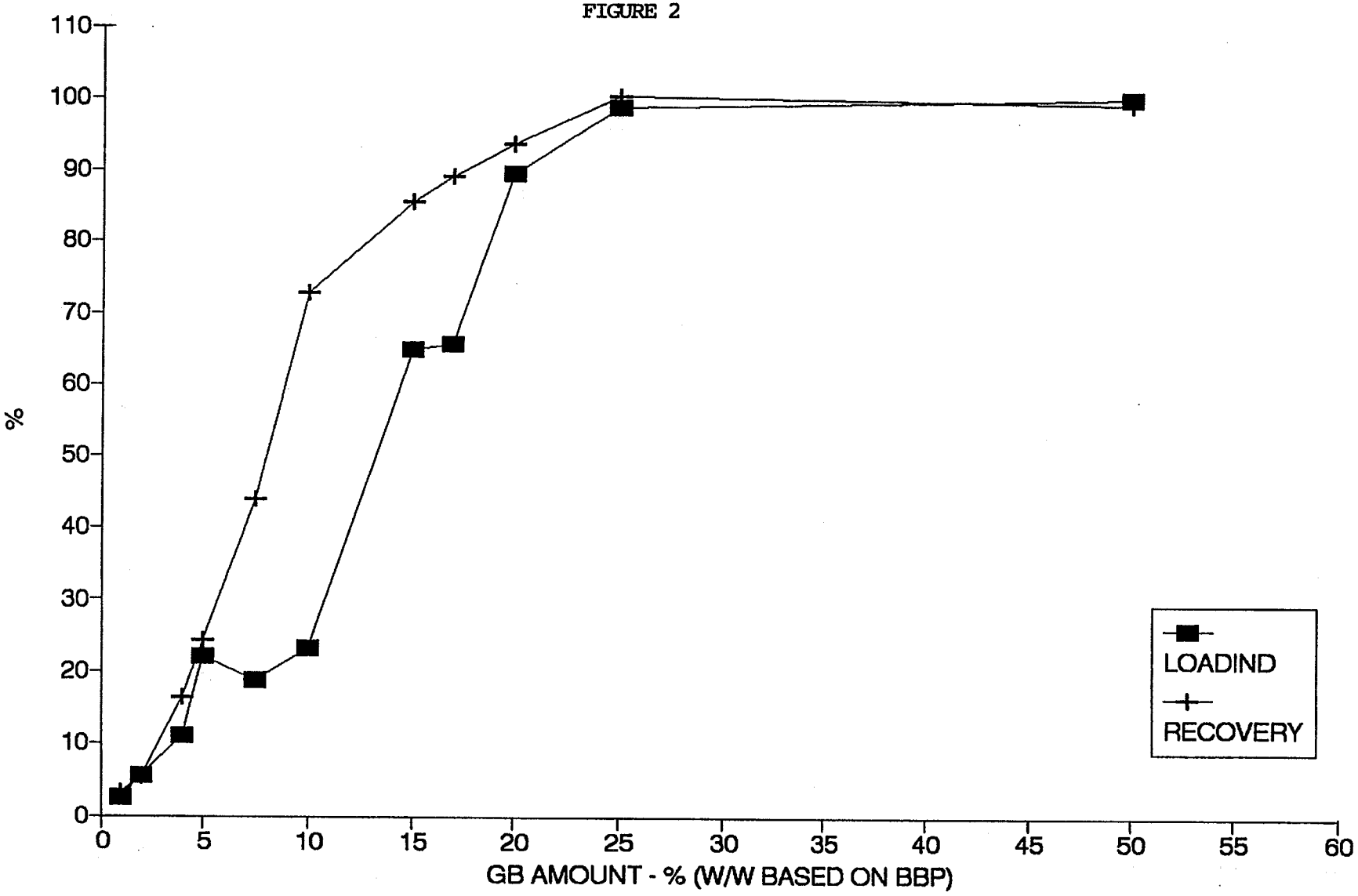

FIG. 2: 0.1 g BBP, with varying amounts of isopropylamine dodecylbenzenesulfonate, were dissolved in Isopar L to make 100 g total solution.

Figure 3:
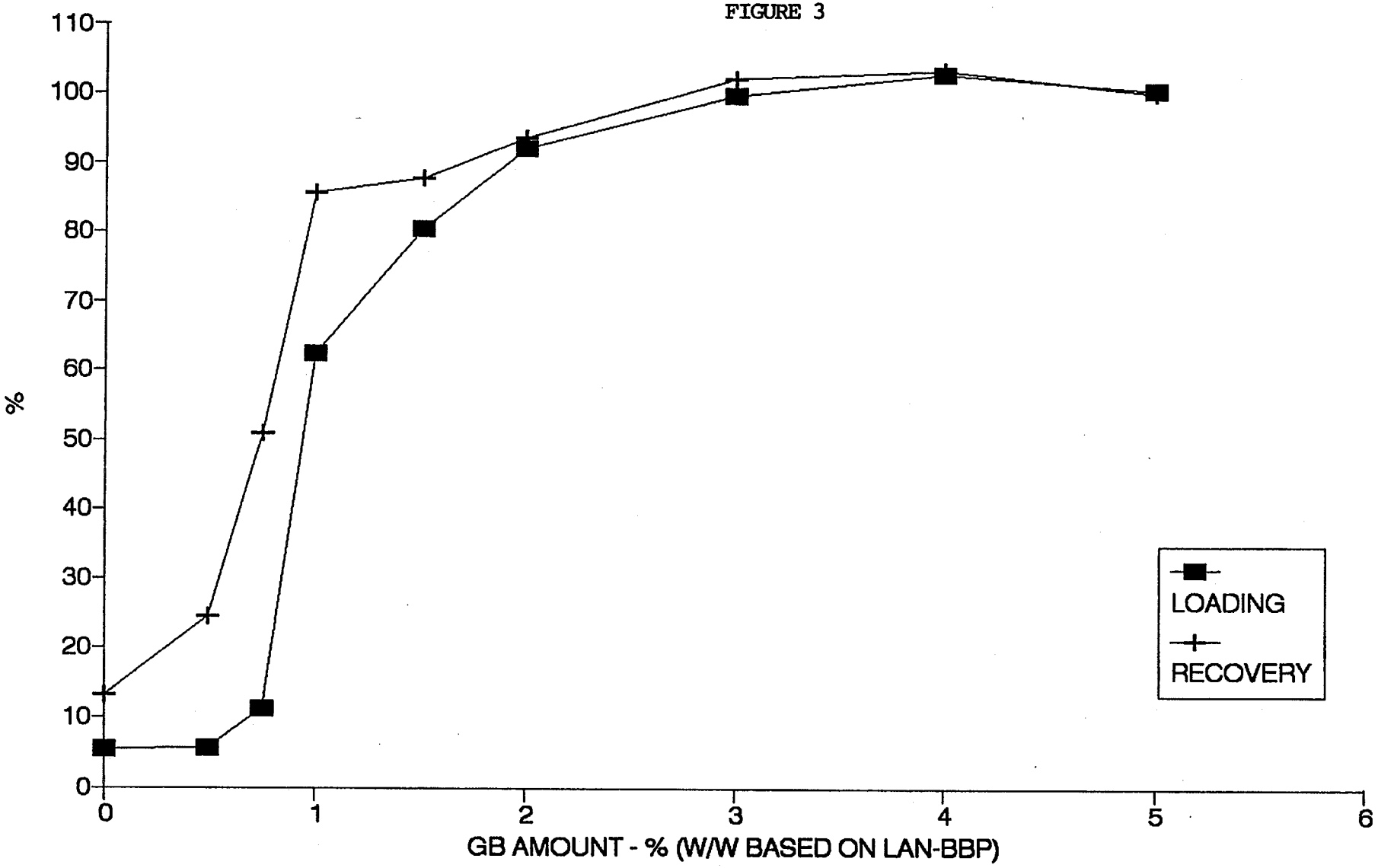

FIG. 3: 0.05 g lecithin (LAN) and 0.05 g BBP, with varying amounts of isopropylamine dodecylbenzenesulfonate, were dissolved in Isopar L to make 100 g total solution.

Figure 4:
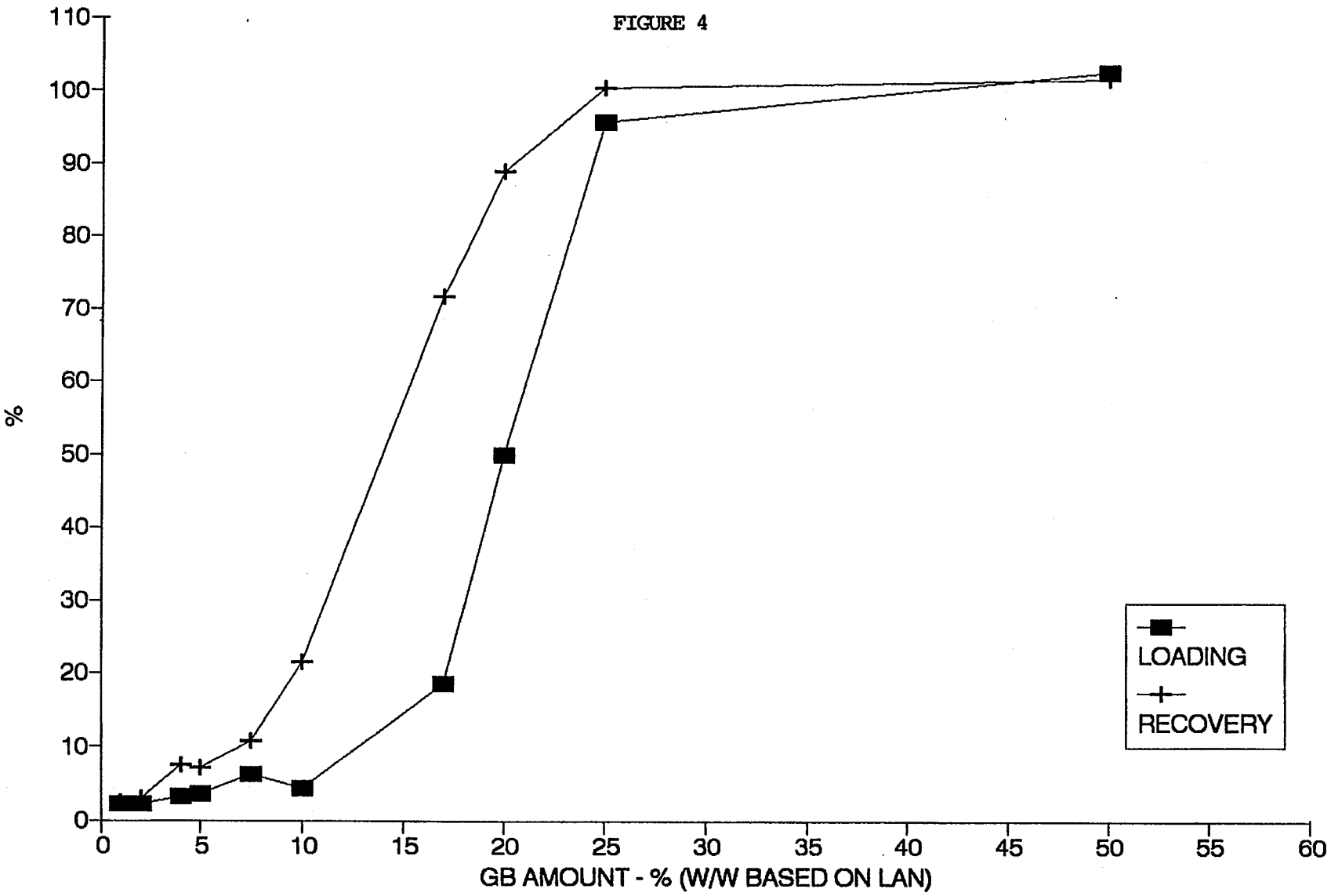

FIG. 4: 0.1 g lecithin (LAN), with varying amounts of isopropylamine dodecylbenzenesulfonate, were dissolved in Isopar L to make 100 g total solution.

As is clearly seen from these Figures, the addition of stabilizing components to solutions of charge director material substantially improves the stability of these solutions.

Conductivity kinetics (stability of conductivity with time)

Figure 5:
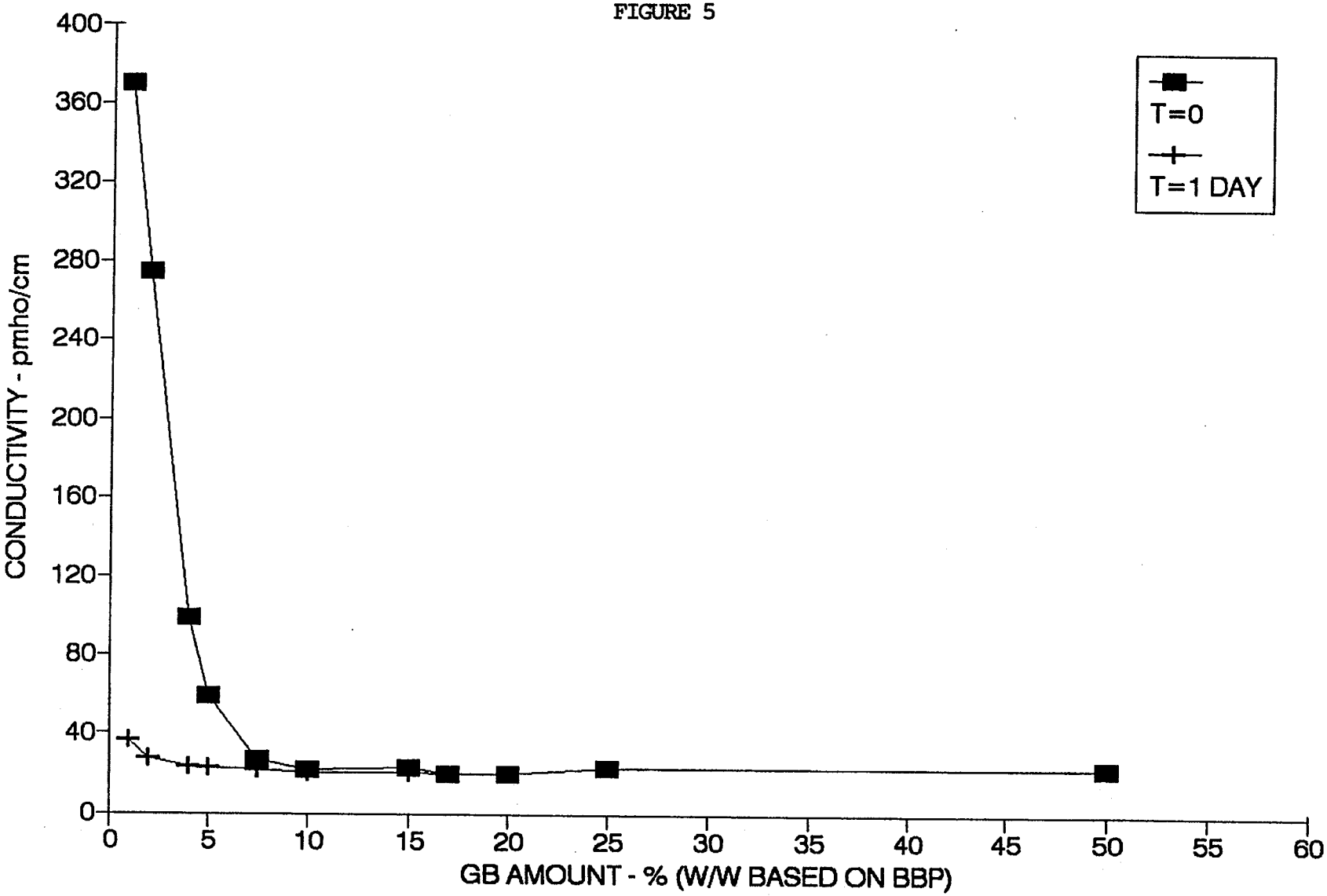
FIG. 5 shows the effect of an exemplary stabilizing component of the invention on the conductivity of compositions containing charge director.

The effect of an exemplary stabilizer of the invention (isopropylamine dodecylbenzenesulfonate) on conductivity degradation, following dilution to 0.1 wt. % charge director, from a stock solution of 10% BBP or lecithin or a 5%+5% BBP-lecithin mixture, in Isopar L to a 0.1% solution in Isopar L, is presented in FIG. 5. This Figure shows that the conductivity of these solutions was stabilized when they contained (based on charge director) at least approximately 7.5 wt. % stabilizer.

While the present invention has been particularly described, persons skilled in the art will appreciate that many variations and modifications can be made. Therefore, the invention is not to be construed as restricted to the particularly described embodiments, rather the scope, spirit and concept of the invention will be more readily understood by reference to the claims which follow.

I claim:

1. A homogeneous liquid composition, for use in the preparation of liquid toners containing at least one charge director and in which the electrical properties of the charge director(s) is/are stabilized, which composition comprises:

(1) insulating non-polar carrier liquid compatible with liquid toners for electrostatic imaging;

(2) at least one charge director other than an amine salt; and (3) at least one stabilizing component in an amount effective to stabilize the electrical properties of said at least one charge director, said component being selected from non-quaternary amine salts and being soluble in the carrier.

2. A homogeneous composition according to claim 1, wherein said insulating non-polar carrier liquid comprises an insulating non-polar liquid hydrocarbon having a volume resistivity above $10^9$ ohm-cm and a dielectric constant below 3.0.

3. A homogeneous composition according to claim 1, wherein the weight ratio of stabilizing component to charge director falls within the range of 0.001–2.0:1.

4. A homogeneous composition according to claim 1, wherein component (3) is selected from non-quaternary salts of aliphatic amines with an acid selected from inorganic acids and alkyl-substituted aromatic sulfonic acids.

5. A homogeneous composition according to claim 1, wherein component (3) is selected from diethylammonium chloride and isopropylamine dodecylbenzenesulfonate.

6. A homogeneous composition according to claim 1, preceding claims, wherein said at least one charge director is selected from lecithin, basic barium petronate and calcium petronate.

7. A homogeneous composition according to claim 6, wherein component (3) is selected from diethylammonium chloride and isopropylamine dodecylbenzenesulfonate.

8. A liquid toner for electrostatic imaging which comprises insulating non-polar carrier liquid, colorant particles, at least one charge director other than an amine salt, and at least one stabilizing component in an amount effective to stabilize the electrical properties of said at least one charge director, said stabilizing component being selected from non-quaternary amine salts and being soluble in the carrier.

9. A liquid toner according to claim 8, wherein said insulating non-polar carrier liquid comprises an insulating non-polar liquid hydrocarbon having a volume resistivity above $10^9$ ohm-cm and a dielectric constant below 3.0.

10. A liquid toner according to claim 8, wherein the weight ratio of stabilizing component to charge director falls within the range of 0.001–2.0:1.

11. A liquid toner according to claim 8, wherein said stabilizing component is selected from non-quaternary salts of aliphatic amines with an acid selected from inorganic acids and alkyl-substituted aromatic sulfonic acids.

12. A liquid toner according to claim 8, wherein said stabilizing component is selected from diethylammonium chloride and isopropylamine dodecylbenzenesulfonate.

13. A liquid toner according to claim 8, wherein said at least one charge director is selected from lecithin, basic barium petronate and calcium petronate.

14. A liquid toner according to claim 13, wherein said stabilizing component is selected from diethylammonium chloride and isopropylamine dodecylbenzenesulfonate.

15. A liquid toner for electrostatic imaging which comprises thermoplastic resin particles dispersed in an insulating non-polar carrier liquid having a volume resistivity above $10^9$ ohm-cm and a dielectric constant below 3.0; colorant particles micro-dispersed in said carrier liquid; at least one charge director other than an amine salt; and at least one stabilizing component in an amount effective to stabilize the electrical properties of said at least one charge director, said stabilizing component being selected from non-quaternary salts of aliphatic amines with an acid selected from inorganic acids and alkyl-substituted aromatic sulfonic acids, and being soluble in the carrier.

16. A liquid toner according to claim 15, wherein the weight ratio of stabilizing component to charge director falls within the range of 0.001–2.0:1.

17. A liquid toner according to claim 16, wherein said stabilizing component is selected from diethylammonium chloride and isopropylamine dodecylbenzenesulfonate.

18. A liquid toner according to claim 16, wherein said at least one charge director is selected from lecithin, basic barium petronate and calcium petronate.

19. A liquid toner according to claim 17, wherein said stabilizing component is selected from diethylammonium chloride and isopropylamine dodecylbenzenesulfonate.

20. An electrostatic imaging process which comprises the steps of: forming a charged latent electrostatic image on a photoconductive surface; applying to said surface charged colorant particles from a toner composition which comprises insulating non-polar carrier liquid, colorant particles, at least one charge director other than an amine salt and at least one stabilizing component in an amount effective to stabilize the electrical properties of said at least one charge director, said stabilizing component being selected from non-quaternary amine salts and being soluble in the carrier; and transferring the resulting toner image to a substrate.

* * * * *